US008622364B2

(12) United States Patent
Bergman

(10) Patent No.: US 8,622,364 B2
(45) Date of Patent: Jan. 7, 2014

(54) APPARATUS AND METHOD FOR REPLACING A ROTTED PORTION OF A SUPPORT POST AND SECURING THE POST TO A SURFACE OR PIER

(76) Inventor: Richard Bergman, Ottawa (CA)

( * ) Notice: Subject to any disclaimer, the term of this patent is extended or adjusted under 35 U.S.C. 154(b) by 198 days.

(21) Appl. No.: 13/180,514

(22) Filed: Jul. 11, 2011

(65) Prior Publication Data

US 2012/0006964 A1 Jan. 12, 2012

Related U.S. Application Data

(60) Provisional application No. 61/362,871, filed on Jul. 9, 2010.

(51) Int. Cl.
*F16M 13/00* (2006.01)

(52) U.S. Cl.
USPC ..... 248/523; 248/684; 248/546; 248/534; 52/376; 52/361; 52/362

(58) Field of Classification Search
USPC ..... 248/523, 511, 534, 535, 519, 684, 248/176.1, 188.1, 346.01, 530, 545, 546, 248/547; 52/745.17, 361, 376, 362, 165, 52/298, 155, 158
See application file for complete search history.

(56) References Cited

U.S. PATENT DOCUMENTS

| | | | | |
|---|---|---|---|---|
| 3,264,021 | A * | 8/1966 | Artman | 403/3 |
| 5,090,656 | A * | 2/1992 | Brown | 248/545 |
| 5,660,013 | A * | 8/1997 | Saldarelli et al. | 52/296 |
| 6,340,147 | B1 * | 1/2002 | Dymarczyk | 248/530 |
| 7,627,995 | B1 * | 12/2009 | Yoder | 52/170 |
| 7,730,675 | B2 * | 6/2010 | Hill | 52/153 |
| 8,117,798 | B2 * | 2/2012 | Bergman | 52/745.17 |

* cited by examiner

*Primary Examiner* — Todd M. Epps

(57) ABSTRACT

A post support device that enables a rotted base portion of a wooden support post to be removed in situ and the remaining end of the support post to be secured for regained structural integrity, the device having a base adapted to being attached to the surface, elevation support means in cooperation with the base for supporting the post above the base, at least two cover plates, each adapted to covering a portion of the exterior of the post, and each including an elongate flange facing inward towards the post and generally transverse to the longitudinal axis of the post, said flange portion including a leading cutting edge to enable the flange portion to bite into the surface material of the post upon the application of force to the flange to provide a mechanical seal between the flange and the post, first and second fastening means for securing each cover plate to the post and the base and the elevation support means to the post or the filler block if one is used, respectively.

10 Claims, 7 Drawing Sheets

APPARATUS AND METHOD FOR REPLACING A ROTTED PORTION OF A SUPPORT POST AND SECURING THE POST TO A SURFACE OR PIER

BACKGROUND OF THE INVENTION

1. Field of the Invention

The present invention generally relates to post support devices and methods for wooden support posts that are typically connected to concrete piers or other surfaces such as wood porches, balconies or surfaces where water or moisture pervades the environment, and more particularly to post support devices and methods to minimize or repair rotting at the base in such wooden support posts because of prolonged exposure to the elements.

2. Description of Related Art

In the field of construction there is a common problem of wood support posts rotting at the base because of prolonged exposure to the elements. These posts may be connected to concrete piers or other surfaces such as wood porches, balconies or any surface where water or moisture pervades the environment.

End grain of dimensional lumber has a natural capillary structure that aids the tree when it is living but which can be detrimental to wooden structural members if kept constantly wet. Water is sucked up by the end grain thus creating an optimal environment for rot and mould to establish itself and eventually destroy the integrity of the support post.

In other environments, pests such as termites are the threat. Open access to wood fiber at ground or surface level allows termites to gain access to a food source and begin their destructive work.

Support posts that are structurally compromised at the base can be a very expensive problem to fix. Support posts are often in such sizes as 6×6 (inches) dimensions or greater and are usually well connected into a supported framed structure above the remote end of the post making their removal laborious and costly.

These support posts rest upon concrete piers below porches, or decks or other similar structures, or they can be resting on the top decking surface of a porch and may be turned on a lathe, shaped and painted for decorative or cosmetic effect, in addition to supporting a roof structure above.

Rot and termite damage tends to progress up the inside core of a post much like a cone. This means that while a small area of rot may be visible from the exterior, the rot may extend much higher within the post.

There are a number of examples in the prior art of elevated post support devices designed to be used during new construction where easy installation is possible because the support post has not yet been installed into the structure. One can easily gain open access to the bottom of the post or the device is already secured to a concrete footing and the post can be dropped into position over the device.

However, if a rotted post is to be repaired, the prior art envisions that the rotting post be completely removed from the structure first and that a new post be installed in the same fashion and procedure as if it were new construction. The prior art envisions that the method of installation or repair accommodate to the height restrictions of the device rather than the device being capable of adapting within a typical and modest height range of rot within a post.

This means that the repair solution required when using the prior art devices necessitates complete removal of the post, which entails new material cost and labor. The prior art devices and methods do not lend themselves easily to situations where one desires to remove only the rotted portion of the post so that the rest of the post can be saved, thereby reducing replacement cost and labor. And yet this is a desirable choice given the high cost of replacing large structural posts that are typically securely connected to the remaining framing structure above while only five or six inches of rot exists at the bottom.

The prior art devices are only designed to provide a support post sufficient building code mandated clearance of at least one inch for all non-preservative treated ends of posts. But once rot sets in it almost always extends further than one inch from the surface of the grade. In fact the extent of rot may vary significantly depending of many factors such as snow and ice accumulations, direct or indirect exposure to rain or moisture.

While the prior art devices could be modified to accommodate whatever height one might anticipate rot could extend to, doing so would require numerous different height sizes to be made in anticipation of varying extents of rot. Or a single design which might be tall enough to function in a less common situation where the rot extends far above average heights might also be contemplated to cover as many instances as possible.

But such a device would be more than is required in many other instances, thus would be more expensive to manufacture. That is perhaps one of the reasons why the prior art has focused on devices which only meet the minimum building code elevation of one inch above a surface.

Another problem with the prior art devices is that they do not allow for variability during the installation, even within a reasonable range, so that the height at which a rotted post is cut is close to where healthy wood begins to predominate. The prior art devices offer no range of elevation in which to work beyond their discrete height.

The prior art devices are designed so that they connect to the post by way of external vertical planer surfaces that run up along the wall of the post and are secured to the post with fasteners. As a result, there is no seal to prevent water from seeping in between the post and the vertical planar surface. They are simply compressed against the post and screwed in place. As a result moisture is retained longer between post and planar surface and can gain access to the core of the post through the entry point of the fastener. These weaknesses leave the new post no better protected from moisture damage and eventual structural decay than the previous post with the same supporting device.

Some prior art (Scholl) devices are designed to protect a pier and a post combination by using compressive means around a post to create a seal in combination with a large cavity that encircles post and pier. It does not envision a mechanical seal which cuts into and penetrates beyond the plane of the post wall. This is clearly advantageous given its permanency and long term reliability when compared to applying caulking around the perimeter of the post where the support device planar surfaces terminate.

And yet one more factor is ignored by the prior art which renders their use ineffective or impractical in repair or renovation situations long after original construction. These are instances where a post to be repaired has been connected to a concrete surface by way of a device which has some kind of appendage or leg embedded into the concrete. This occurs at the time of construction whereby an anchoring appendage is submerged into wet cement and left to cure.

If one of the prior art devices were desired to be used in such a repair situation, it would entail cutting off the embedded appendage and removing a portion of concrete sufficient for another like device to be embedded within new cement poured into this cavity within the pier. This would be laborious, costly and time consuming. A device that is surface mounted to cured concrete would be the only reasonable solution even though the old embedded anchoring appendage would still have to be cut off.

To further demonstrate the utility and benefit of having a device with both variability in height range and a means of sealing and protecting the connection between post and device, consider one element of a repair technique that would be part of the method used when employing such an ideal device.

A simple method of fixing a rotted post that sits directly on a surface, without any kind of post support anchor, is to cut the post above the rotted portion and remove it. A new replacement filler block could be cut from identically dimensioned lumber so that it would fit snuggly within the void. Construction adhesives may be applied to the contact surfaces of the end of the old post and replacement filler block. However, this would likely doom the filler block to the same fate as its predecessor given that exposure to the elements would continue at the post to base surface interface and also at the joint between the filler block and post.

Alternatively, a traditional metal post support device could be used to secure the replacement filler block whereby screws pass through it into the filler piece connecting the two. The support device with the attached filler block can now be fitted underneath the hanging post and fastened to the concrete pier. In such a case, the height of any post support device would also have to be accounted for so that it and the filler block closely filled the void.

From a functional perspective, these two solutions, however crude, would at best address the compression strength required of the adapted support post. However, the lateral strength would still be a concern given that adhesive is all that binds the filler block and post.

This concept does offer some cosmetic benefits as it creates a support post with an identical profile as the original post. Further sanding and use of resin fillers and painting can result in a high quality aesthetic finish close to the original. However the joints or interfaces between surface, filler block and post remain exposed to the elements.

If the joint is not repaired properly and it remains close enough to the base surface such that it is within the zone of exposure to the elements, the process of rot is set to repeat itself once again. This concept is incomplete and far from optimum.

In summary, there remain significant issues of concern with this method of a repair such as inadequate lateral or torsion strength at the union of the old and new filler material, lack of protection of the union interfaces from further exposure to the elements or pests, and keeping the base of the filler block post bottom dry.

Therefore there is a need for an elevated surface mounted post support device that a) addresses the need for a permanent and reliable long term mechanical sealing system between post walls and the vertical planar surfaces of the device that connect to and secure the post; b) provides a high degree of compression, lateral impact and torsion strength; c) meets the minimum building code gap requirements between post and surface; and d) can be used in a range of situations where the progression of rot within a support post extends to varying heights.

The devices and methods of the present invention are provided to fulfill one or more of these needs as will be understood from the following description.

SUMMARY OF THE INVENTION

In order to address some of the shortcomings in the prior art, some aspects of the present invention provide a post support device that enables a rotted base portion of a wooden support post to be removed in situ and the remaining end of the support post to be secured for regained structural integrity, the device comprising a base adapted to being attached to the surface; elevation support means in cooperation with the base for supporting the post or a filler block if one is used in a position above the base; at least two cover plates, each cover plate being adapted to covering a portion of the exterior of the post, each cover plate further including an elongate flange portion facing inward towards the post and being positioned generally transverse to the longitudinal axis of the post, said flange portion including a leading cutting edge to enable the flange portion to bite into the surface material of the post upon the application of force to the flange portion to provide a mechanical seal between the flange portion and the post; first fastening means for securing each cover plate to the post; and second fastening means for securing the base and the elevation support means to the post or the filler block if one is used.

In some embodiments, the cover plate may define a top edge and the flange portion may be adjacent the top edge, the top edge may further include at least one V-shaped cutout to enable the flange portions on either side of the cutout a limited range of movement relative to each other.

In some embodiments, the elevation support means may comprise a raised area embossed into the base. In some embodiments, the elevation support means may comprise a formed member being connectable to the base and having an elevational thickness that supports the post or the filler block if one is used in a position at that distance above the base. Preferably, the elevational thickness is at least one inch.

In some embodiments the device may further include upwardly extending tabs on an upper surface of the base wherein the tabs are located on the inside and are aligned with the cover plate when the device is assembled, and third fastening means for securing each cover plate to at least one of said tabs.

In some embodiments, the elevation support means may define a periphery that is smaller than the periphery of the post or the filler block if one is used.

In some embodiments, the cover plates together in the assembled device completely envelope the periphery of the post. In some embodiments, each cover plate may further includes complementary overlapping side edges at each end, one being an underlying edge and the other being an overlying edge, wherein the overlying edge of one cover plate overlaps with the underlying edge of the adjacent cover plate. Fourth fastening means may be included for interconnecting the overlapping side edges on adjacent cover plates and simultaneously securing them to the post.

Preferred embodiments may comprise several components; a planar base with either an integrally formed elevated zone contained within the periphery of post walls or a separate component that creates a taller space between the planar base and the post, either of which would connect to the post bottom elevating it from the surface; at least two post cover panels that wrap around the post above and below a joint between a new filler block material and the original post (if a filler block were used); inwardly bent sharp edges adjacent the upper edges of the cover panels which can be driven or impaled into the side wall of the post to create a mechanical seal; and fasteners to connect the parts to each other and to the post.

The devices of the present invention could be used in new construction applications where a filler block would not be necessary as the device would be screwed directly onto the end of the new post followed by the cover panels. Thereafter, the new post and base support device could be fastened to the concrete pier. However, the devices' full potential, greatest value and most unique attributes are fully realized when used to repair old rotted wooden support posts.

The planar base surface separates the bottom of the post from the concrete pier or deck surface to which it connects, and where moisture or pests typically reside. At a minimum this planar base surface would be elevated at least ¼ inch by virtue of embossed or stamping the base material. The planar base may connected either directly to the end of a new post or to a replacement filler block by conventional fastening means. In the case of repair of an old post, the filler block fits directly underneath the cut end of the old post.

In another embodiments there may be a separate component sometime called a "stand off" that lifts the post higher above the concrete surface. Ideally this space should at least meet the building code minimum standard of 1" for use with un-treated post ends. This "stand off" component is preferably made of square or rectangular tubing or could be made of stamped metal or an injection molded high density synthetic material. If it is made of metal it would be welded to the base plate of the device. In either case the "stand off" component is not subject to moisture damage and serves the purpose of elevating the bottom of the filler block or the original post (if a filler block is not used) to meet the minimum building code standards.

The two post cover panels wrap around the post overlapping each other and connecting tightly, while the upper edge of the panels have sharp inwardly pointing flanges or blades that cut circumferentially into the post walls creating a mechanical seal. Fasteners are screwed through overlapping and non overlapping portions of the panels above and below the filler block-to-post joint ensuring the entire combination of post and device becomes strong.

The ideal device is intended to connect either directly to the end of a support post or to a replacement filler block and the remaining cut end of a support post, so as to; a) provide compression, lateral impact and torsion strength; b) protectively seal around the post walls above the joint; and c) provide a dry and sealed joint connection between the bottom of the filler block and the base connection means to a surface. It does not address the issue of providing a compressive seal while covering or sheltering an entire post to pier connection.

The cover panels can be designed for a standard height of approximately 6 to 8 inches, which might be sufficient for vast majority of rotted post repair situations, or they may be shorter or taller, as required. The elevated embossed or "stand off" portion of the device could remain constant. But the height of the cover panels allows for a reasonable range within which to choose exactly where to cut off a rotted portion of post. Since the extent of rot may differ from one post to another it is useful to have a device which can affordably operate and adapt in these situations.

It should be understood that the prior art post support devices are designed to only marginally separate a post from a surface; typically no more than one inch. They are designed to provide only a discrete separation between a post and surface rendering them ineffective in most post repair situations. And, because there is no variability in their application, they work best in new construction only. If they must be used for repair work, the entire post must be replaced with a new post. No seal is provided where the side members of these devices connect to the post. The side members are usually intended to be nailed or screw against the post wall.

As has been shown herein, the present invention with the cover panels and the ability to use them with a custom sized filler block (within a range depending on the height of the cover panels) is easily adaptable to situations where much more than one or two inches of rot must be removed. As well, the sharp edged blade of the cover panels creates a reliable and clean looking seal for better protection. The concept of the sharp edged blade is vast improvement over any concept that provides a member that merely sits flat against a post wall. In such a case, a bead of caulking would have to be applied around the entire perimeter of the post. The caulking would account for the integrity of the entire seal and require frequent maintenance and attention. In contrast, the present invention that provides a mechanical seal for all but the very small corner portions improves long term performance significantly.

BRIEF DESCRIPTION OF THE DRAWINGS

For a better understanding of the present invention and to show more clearly how it may be carried into effect, reference is made by way of example to the accompanying drawings in which.

DETAILED DESCRIPTION OF THE INVENTION

Figure 1:
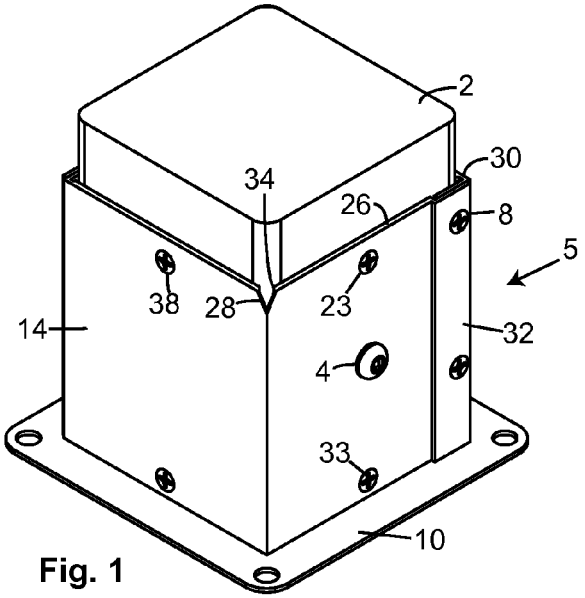
FIG. 1 is a perspective view of an embodiment of a post support device in accordance with the present invention showing the finished appearance with the cutting blades of the cover panels embedded in the side walls of the post.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Figure 2:
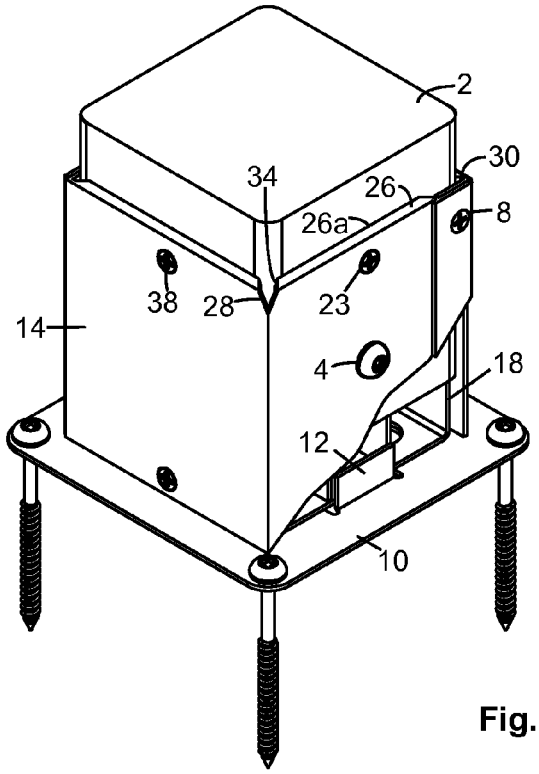
FIG. 2 is a perspective view of the device in FIG. 1 with a portion cut away, partially revealing an embodiment of the stand-off base and the post inside the device.
Figure 3:
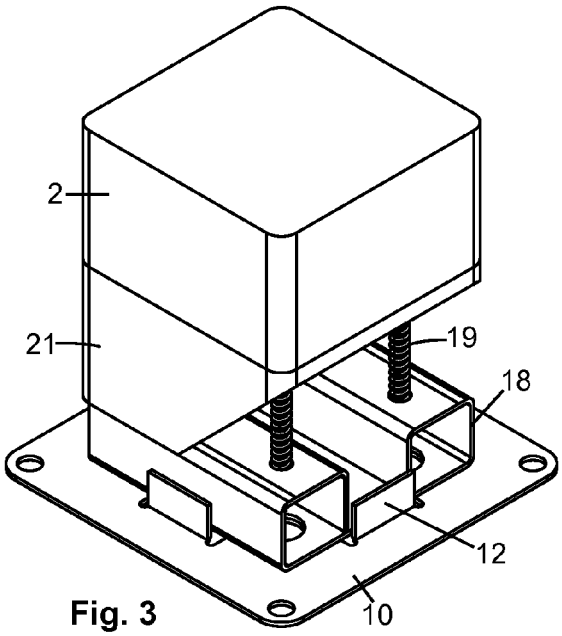
FIG. 3 is a perspective view of the device in FIG. 1 without the cover panels to illustrate how a filler block is used with the apparatus for post repair applications and a cutaway perspective of the filler block shows screws that come from underneath the stand-off and base.

Referring to FIGS. 1-3, there is depicted an embodiment of a post support device 5 in accordance the present invention. Post support device 5 comprises a base such as flat base plate 10 and an elevation support means 11 in cooperation with the base. Depending on the application, the elevation support means may be an integrally formed elevated zone 11 that is embossed into the base plate 10, preferably contained within the periphery of post walls, that supports the post in an elevated position above the base hence the ground) such as, for example, by a ¼ inch or more. Alternatively, the elevation support means may be a separate formed member being connectable to the base and having an elevational thickness that supports the post or the filler block if one is used in a position at that distance above the base. An example of a separate formed member is stand-off component 18 which creates a taller space between planar base 10 and post 2. Stand off component 18 may comprise a pair of square or rectangular tubes that are joined to the base 10, as shown. Either of these structures—the elevated zone 11 and the stand-off component 18—elevate the bottom of post 2 from the planar base 10.

Post support device 5 further comprises a pair of cover panels 14 that overlap each other on two faces along complementary overlapping side edges or tabs 30 and 32: tab 30 defining an underlying edge and tab 32 defining an overlying edge. Each cover panel 14 has planar sides that are perpendicular to each other, each side having a width dimensioned to cover the corresponding sides of the post 2, and a typical height of 6-8 inches, or as required for specific applications. Along the top edge of each side of the cover panel 14 is provided a flange 26 bent inward along the top at approximately 90 degrees to the side (hence the post) having a sharp cutting edge 26*a* that is adapted to cut across the grain (transverse to the longitudinal axis of the post) into the side wall of the post 2, thereby the flange 26 functions as a blade.

There is also provided a "V" cut 28 at the corner of the vertical bend in each cover panel 14 which is of sufficient size and depth to permit easy independent lateral movement of the adjacent portions of the planer surfaces of the cover panels. The "V" cut is important because, during the installation of the cover panel 14, lateral strikes with a hammer to the top portions of the sides on the cover panel are required to engage the cutting blade 26 into the side wall of the post, and the "V" cut 28 enables the adjacent top portions of each side on the cover panel 14 to be driven inward.

Furthermore, the side corners 34 of each flange or blade, adjacent to the "V" cut 28, are preferably cut at an angle greater than 90 degrees to the cutting edge 26*a*, more preferably greater than 110 degrees, so that the side corners 34 more easily initiate engagement of the blade into the wood. Installation requires that the bend line at corner of the cover panel 14 and the post corner be aligned with each other. Once they are in close proximity to one another, a light to moderate strike of a hammer at the corner near the "V" cut 28 of the cover panel 14 is sufficient to engage the two adjacent corner points 34 of both cutting blades 26 across the longitudinal grain of the post. Further strikes along one cutting blade 26 at a time to the end of each cover panel 14 will set the blade 26 into the post. First fastening means such as wood screws 23, just below the top edge and approximately at mid span of the cover panel 14, may be inserted through holes 38 and used to fully pull the cutting blade into the post to provide a water tight seal.

The impaling the cutting blades into the side walls of the post is more like a clamping action with a hinge in vertical alignment with the corner of the post whereby the cutting edges 26 are initiating the cut into the post near the corner of the cover panel 14 and post. Therefore the angle of each corner 34 assists in making the initial cut into the wood in cleaner manner than if the corner were a 90 degree corner. With a 90 degree, corner the wood fiber is more apt to be ripped and crushed as the point at the corner 34 of the blade 26 arcs around the hinge point into the side wall of the post. Whereas, with the angled corner 34, the cutting edge 26*a* of the blade 26 is better able to cut the wood grain progressively as it moves across the width of the post. The result is a clean entry point of the blade 26 into the wood at both visible "V" cuts in the post.

Fourth fastening means such as self drilling screws 8 may be used to fasten the cover panels 14 together at overlapping tabs 30 and 32, and to the post. A larger screw 4 is shown in the middle of the cover panel which can be used if desired in applications requiring increased strength, such as, for example, in hurricane environments. An optional third fastening means such as self drilling screw 33 may be used at the base and mid span of the cover panel which fits through a hole in the cover panel and then self drills and taps into a vertical tab 12 formed in the base 10. In this manner, a complete seal is made around the periphery of the post, except for the small V cut openings 28 at the corners, for a support base that is dry, water resistant, and has excellent compression, and torsion strength.

Figure 4:
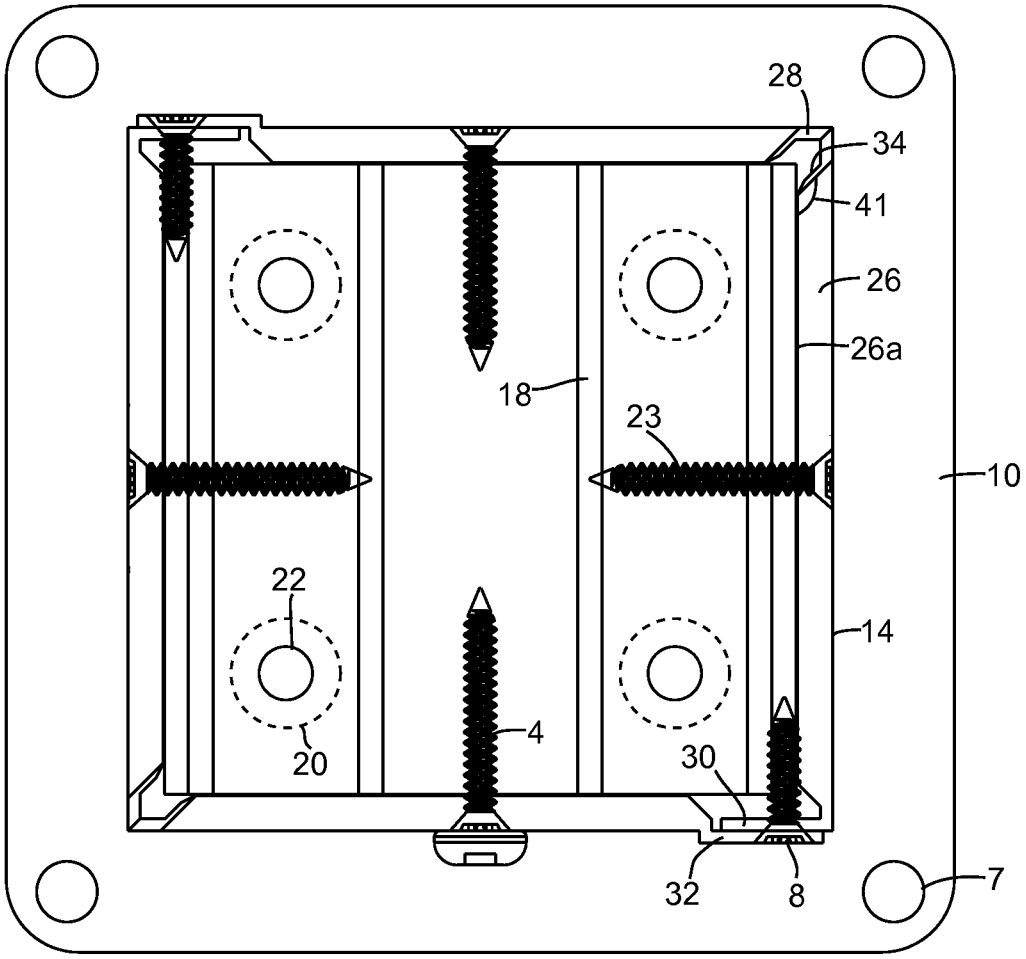
FIG. 4 is a top view of the device in FIG. 1 without the post to illustrate how the cover panels mate at the overlaps and are fastened together.
Figure 5:
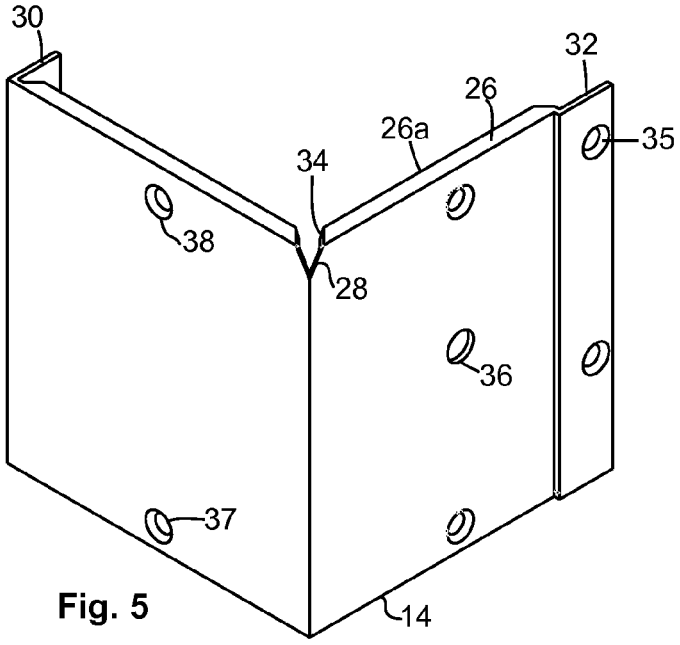
FIG. 5 is a perspective view of a cover panel of the device in FIG. 1.

Referring to FIGS. 4 and 5, further illustration of the self drilling screws 8 and the cover panels 14 are provided. The screws 8 are installed through holes 35 along the overlapping tabs 30 and 32 locking the cover panels together and creating a strong and rigid shell that completely surrounds the base of the post. The cover panels abut themselves up against the vertical tabs 12 formed into the base 10 as they are placed in position around opposing corners of the post. The vertical tabs are closely aligned with the plane of the post walls so that they contact or come close to contacting the back side of the cover panels 14. Self drilling screws 33 can also be inserted through holes 37 at the bottom edge of the cover panels 14 to fasten the panels to the vertical tabs 12 and the base 10. The holding power of this fastening means is in addition to the second fastening means such as larger pan head screws 19 that secure the post or a filler block 21 to the stand-off component 18 and the base. In some environments where hurricanes are possible, it may be necessary to use a middle hole 36 that may be provided in the center of the cover panel and drive a larger fastener 4 through and into the post from opposing sides to provide additional lateral means of support from vertical lift from high winds. The screws 23 along the top edge of the cover panels also act as lateral fastening means to the post but the addition of the larger fastener 4 offers additional strength if needed.

Once the blades 26 have been firmly embedded into the respective sidewalls of the posts, a complete water seal has been achieved around the post except for the small "V" shaped openings 28 at the corners of the panels. These small areas are sealed with a small dab of exterior caulking to complete a perfect watertight seal. These caulking points can be inspected annually, and because of their small size, can easily be peeled away and new caulking applied if necessary.

A benefit of the waterproof shell around the base of the post that the cover panels 14 provide is that the end grain of the post is in a protected zone above where any water may pool. All side installed screws are also sealed effectively by the tight tolerances of the through holes and, since water cannot dribble down between the cover panels and the post walls, it cannot also find its way into the penetration holes in the post. Snow and ice or heavy rains have no effect on the integrity of the base and lower zone of the post that would otherwise be exposed when using the support bases found in the prior art.

Figure 6:
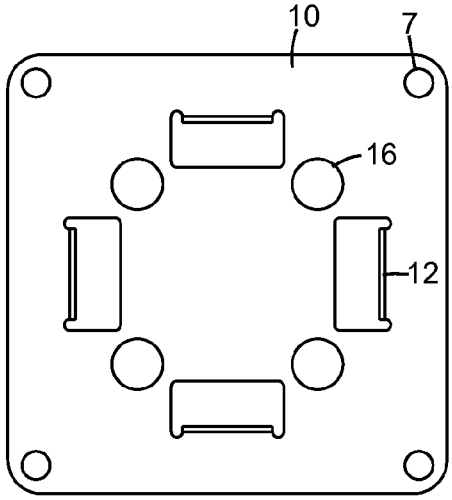
FIG. 6 is a top view of an embodiment of a flat base.
Figure 7:
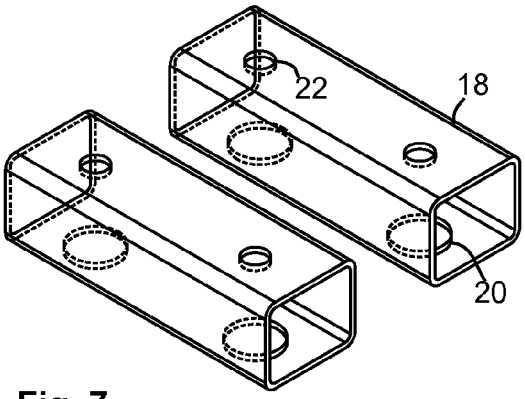
FIG. 7 is a perspective view of an embodiment of the stand-off base.
Figure 8:
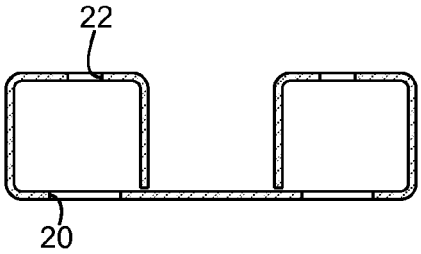
FIG. 8 is a cross section of another embodiment of a stand-off base made from a single piece of sheet metal.

Referring to FIGS. 6-8, the base 10 that is used in conjunction with the stand-off component 18 has large holes 16 in the inner zone that allow the larger heads of fasteners 19 to pass through and into the tubular formation of the stand-off component 18. A similar sized hole 20 is aligned directly over holes 16 in the base with smaller holes 22 directly above permitting the screw 19 to penetrate the bottom face of the post 2 or a filler block 21. The stand-off tubes 18 being welded to the base 10 form an integral unit that can be designed to any height, but preferably at least 1" above the base to comply with certain building code standards for untreated wood posts.

Another simple configuration of base and stand-off component entails forming both tube shapes from a single piece of sheet steel and welding it to the top surface of the base 10.

Also in FIG. 6 are shown the vertical tabs 12 which are ideally formed from the same material as the base to save time and effort. The smaller outer holes 7 allow for wood screws or concrete fasteners to protrude through and secure the base to a surface.

There are basically two scenarios where the device is designed to be used: in post repair situations and in new construction. Post repair situations will require that the rotted lower portion of the post be removed with a saw, preferably with a right angled cross cut that allows a similarly dimensioned piece of lumber or similar materials (i.e. filler block 21) to fit between the remote post end and the stand-off component 18 or elevated embossed base 11, as the case may be depending which embodiment of the base 10 is used. Either the stand-off 18 or embossed base 11 embodiments may be used in new construction but the stand-off provides better protection from moisture given the higher elevation. When a new post is used with either the stand-off 18 or the elevated embossed base 11, the cover panels 14 function in the same manner by wrapping around the post, overlapping along their respective side edges (overlapping tabs), with the blades 26 penetrating the post walls.

For post repair scenarios, the height of the cover panels can be adapted to varying lengths to accommodate a range of common rotting patterns and depths. The benefit to this well appreciated by both homeowners and builders who face a situation of having to extricate a tall, heavy support post built into the framing of an upper deck or balcony. The only portion of the post that is damaged is typically the lower few inches and which requires repair. By using the stand-off embodiment of the device the damaged portion is easily cut off and the original mounting bracket cut off from the concrete or wood surface as well using a reciprocating saw with a metal blade. The filler block 21 is fastened first to the stand-off 18 with the screws 19 and cut to precise height so that when the block 21 and the device are inserted into the opening beneath the cut post there is reasonably tight fit. A small amount of heavy duty construction adhesive can be applied between the mating surfaces of the post 2 and the filler block 21 to enhance the union. Once the cover panels 14 surround the union between post 2 and filler block 21, the post and support base become one rigid unitary piece whereby both compression loads and torsion loads are effectively resisted and withstood. Since the top end of the post remains fixed above into the framing of the upper deck the post remains very strong and resistant to lateral loads at the top or bottom ends of the post. In effect, the integrity of the post and deck or balcony has been restored and the lower region of the post will remain dry and healthy for long periods of time. The appearance of the finished application is improved beyond that offered by solutions found in the prior art, which may be appealing to a certain segment of the population.

Figure 9:
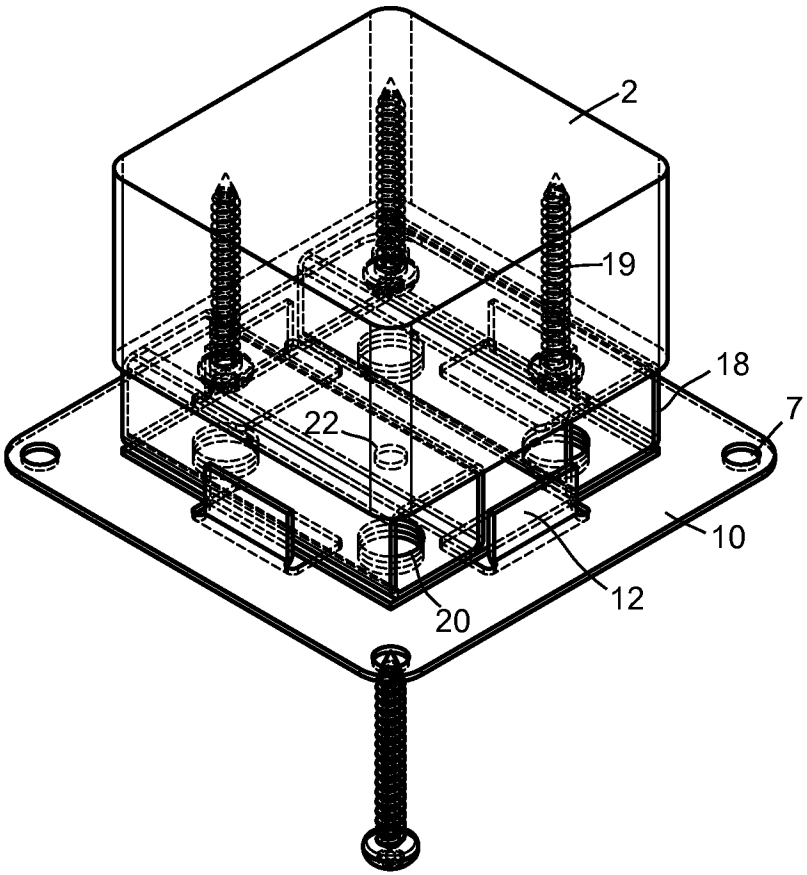
FIG. 9 is a perspective view of the device in FIG. 1 without the cover plates.

Referring to FIG. 9, there is depicted a transparent perspective view of the various components of the apparatus showing the relation of post connection means to the base and stand-off 18. This view without the cover panels 14 reveals how a filler-block 21 can also be employed easily to adapt to the varying and unpredictable range of rot within old posts yet commonly within the range of heights of the cover panels that are manufactured. This view also depicts the fact that in the ideal device, the stand-off component 18 or the periphery of the flat elevated zone 11 of the embossed base lies within the periphery of the post or filler block walls. This ensures that if water somehow gained access on the inside the cover panels, that it would be free to drip down to the base 10 surface and keep the bottom of the post dry.

Figure 10:
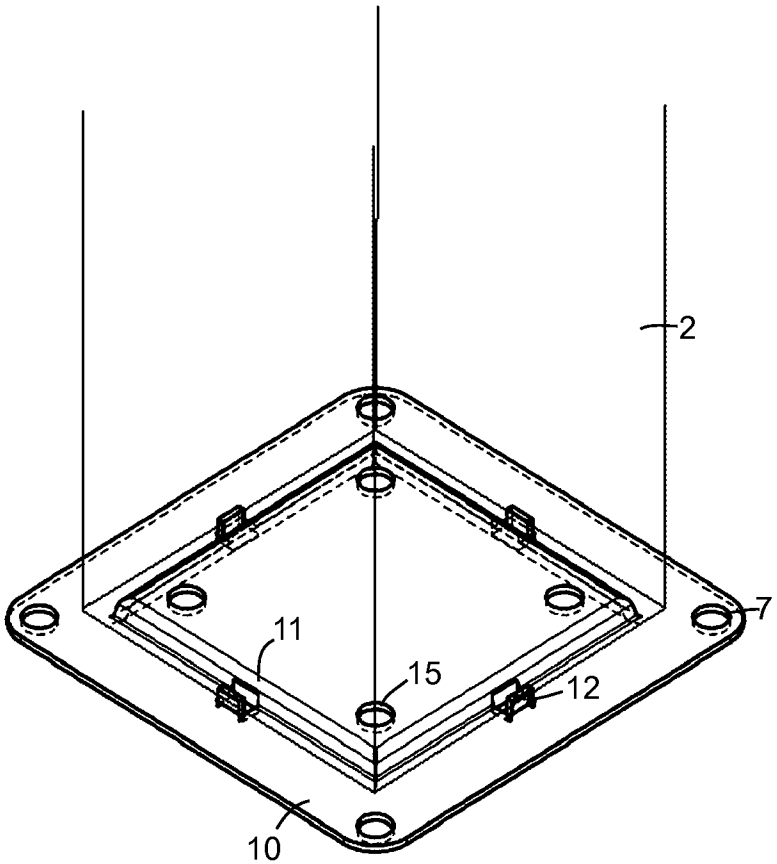
FIG. 10 is a perspective view post on top of an embossed elevated base rather than using the higher elevated stand-off component.

Referring to FIG. 10, there is depicted a similar perspective view to illustrate the relative positions of the post overtop the embossed version of the base 10. Vertical tabs 12 are shown in this illustration but are optional if a single continuous post application is employed. This is because the post can be firmly secured to the base 10 by fasteners 19 from underneath the base. However, in a post repair application it is possible that the tabs 12 may be used for two purposes. First they may serve to provide some alignment assistance of the panels to the base 10 but largely that is provided for if the filler-block 21 is centered evenly over the elevated zone 11 of the embossed base. Secondly, the cover panels are secured to the post by upper screws 8; then secured to the lower filler block by two optional side screws 4; the filler-block further fastened to the base by large screws 19. Lastly, the cover panels may be mechanically secured to the base 10 by using self drilling screws 33 to penetrate the vertical tabs 12 of the embossed base 10.

Figure 12:
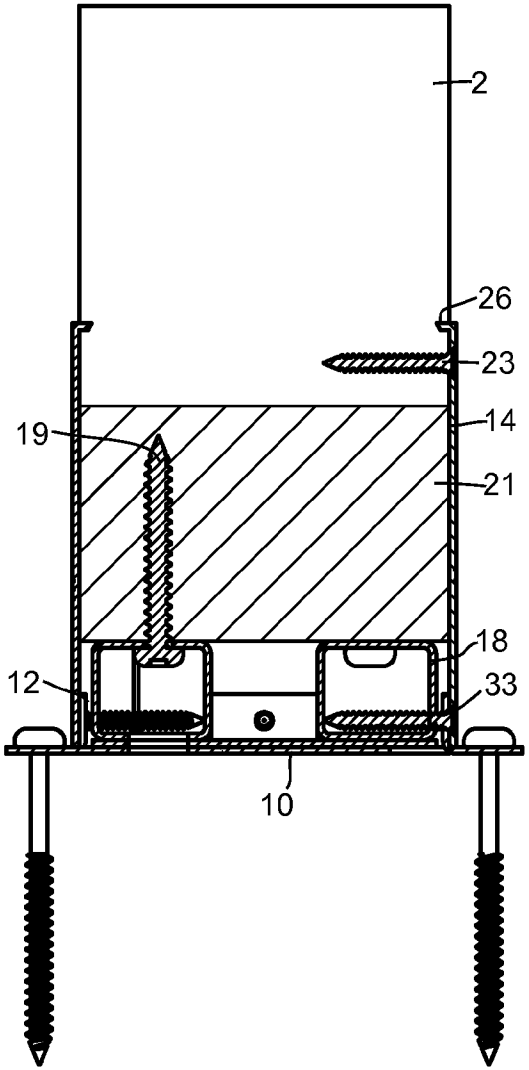
FIG. 12 is a cross section showing the device in FIG. 1 as used in a post renovation application when a stand-off component is employed with a filler block.
Figure 11:
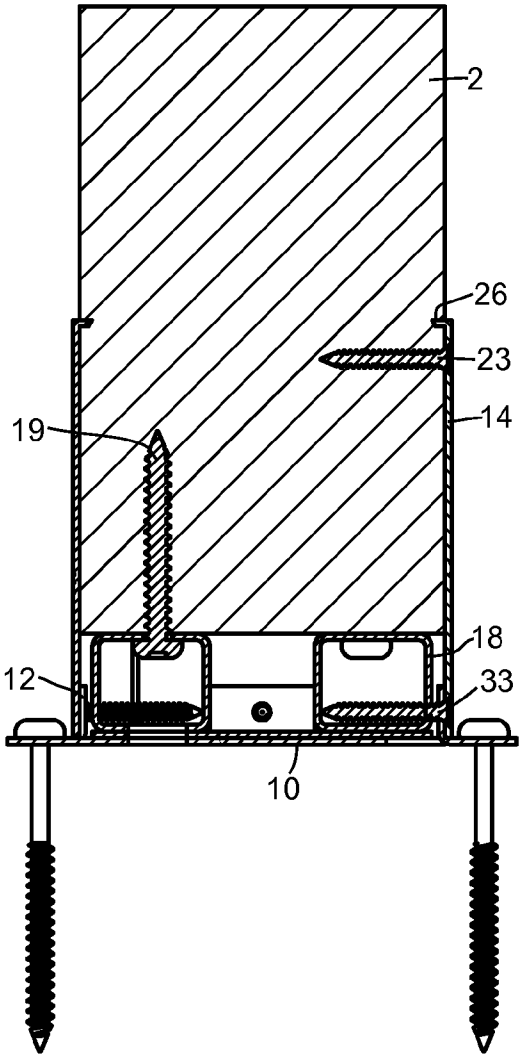
FIG. 11 is a cross section showing the device in FIG. 1 as used in new construction applications when a stand-off component is employed with a single continuous post.

Referring to FIGS. 11 and 12 there is depicted a cross sectional view showing how the apparatus is used in new construction applications when a stand-off component 18 is employed. The cutting blades 26 are fully embedded into the side wall of the post. Wood screws 23 are shown also penetrating the side of the post 2. The heads of the larger screws 19 are shown inside the stand-off tubes 18. Self drilling screws 33 are shown at the base of the cover panel penetrating through the vertical tabs 12 and into the side of the stand-off. Not only is the post secured laterally to the cover panels and the base 10 by virtue of the stand-off component 18 but also by the lower lateral screws 33 through the panel and into tab 12 panel near the base 10. FIG. 9A shows how the apparatus is used in post repair applications using the original post and a filler-block 21.

Figure 13:
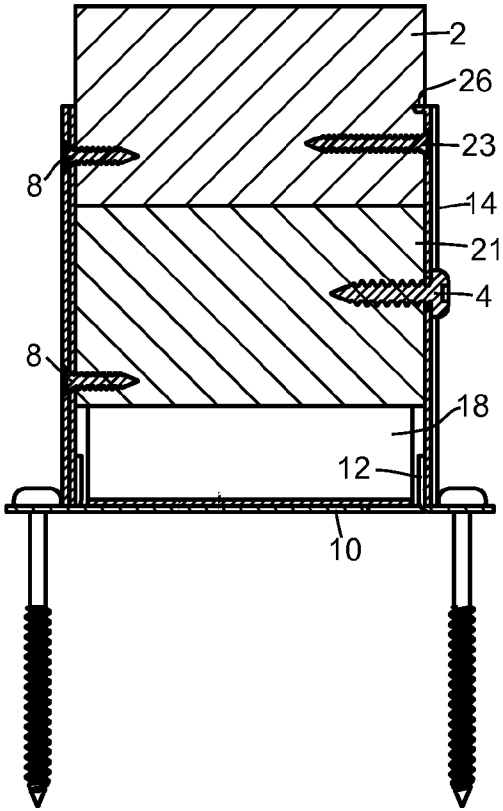
FIG. 13 is a cross section perpendicular to that of FIG. 12 showing the device in FIG. 1 with a filler block and a stand-off component.

Referring to FIG. 13, there is depicted the same apparatus and post configuration as in FIG. 12 but rotated 90 degrees showing the other side of the stand-off 18 and providing a view of the overlapping fasteners 8, top mid span fasteners 23, and optional side screw 4.

Figure 15:
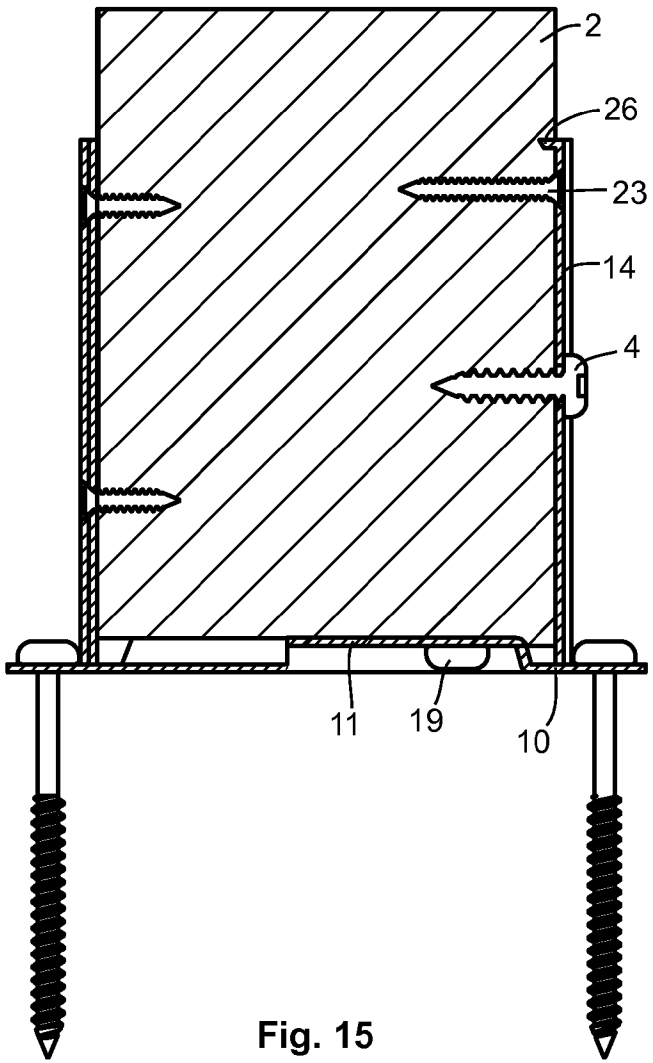
FIG. 15 is a cross section perpendicular to that of FIG. 14.
Figure 14:
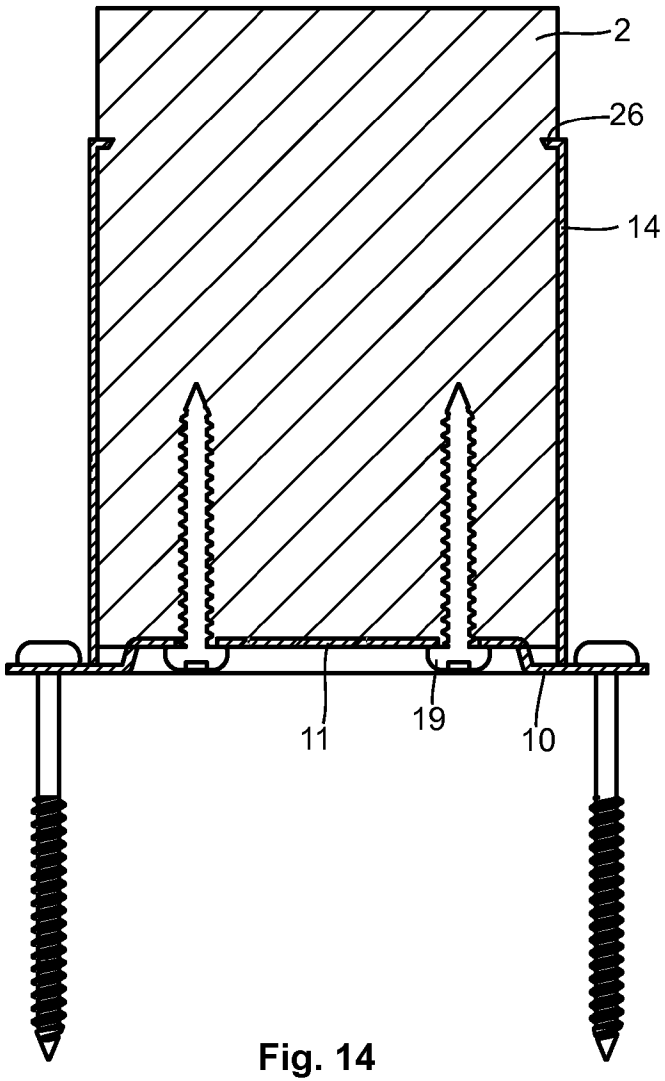
FIG. 14 is a cross section showing an embodiment of the device with an elevated embossed base used with a single continuous post.

Referring to FIGS. 14 and 15, there is depicted cross sectional views showing how the apparatus is used in new construction applications when an elevated embossed base 10 is employed with a single continuous post 2. Fasteners on the sides of the cover panels are not shown in this view in order to emphasize the fastening means at the bottom of the post. The heads of the larger screws are shown fitting inside the cavity under the elevated base. FIG. 15 shows a view that is rotated 90 degrees and illustrates the positions of the various side fasteners through the cover panels. The view begins on the left from the V cut corner of the post thus by-passing the left cutting blade.

Figure 17:
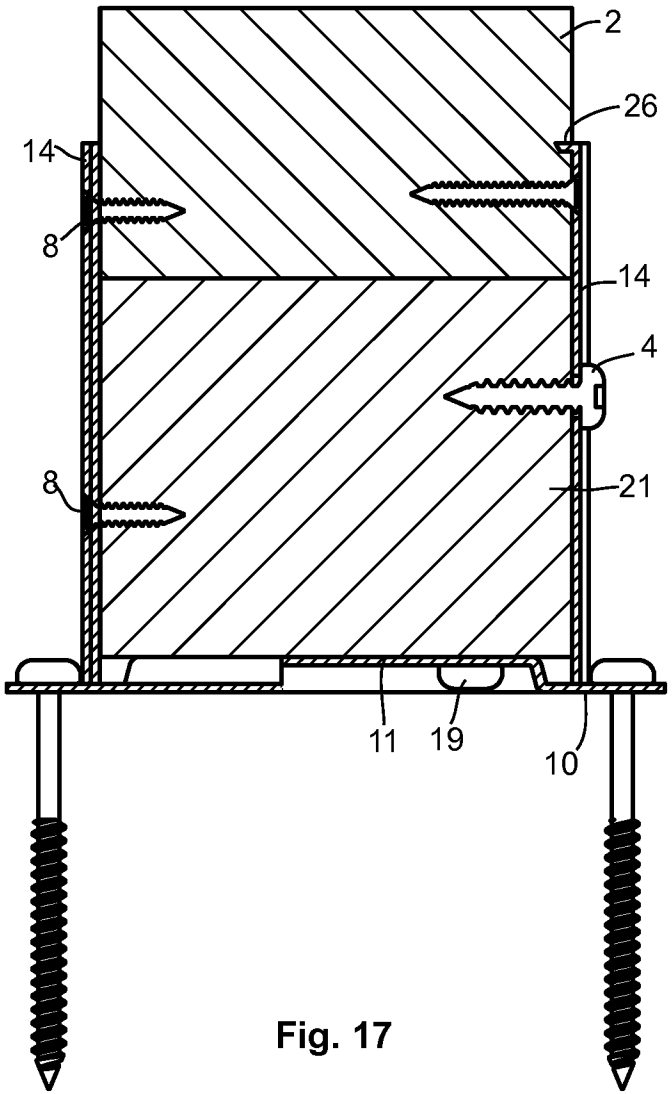
FIG. 17 is a cross section perpendicular to that of FIG. 16.
Figure 16:
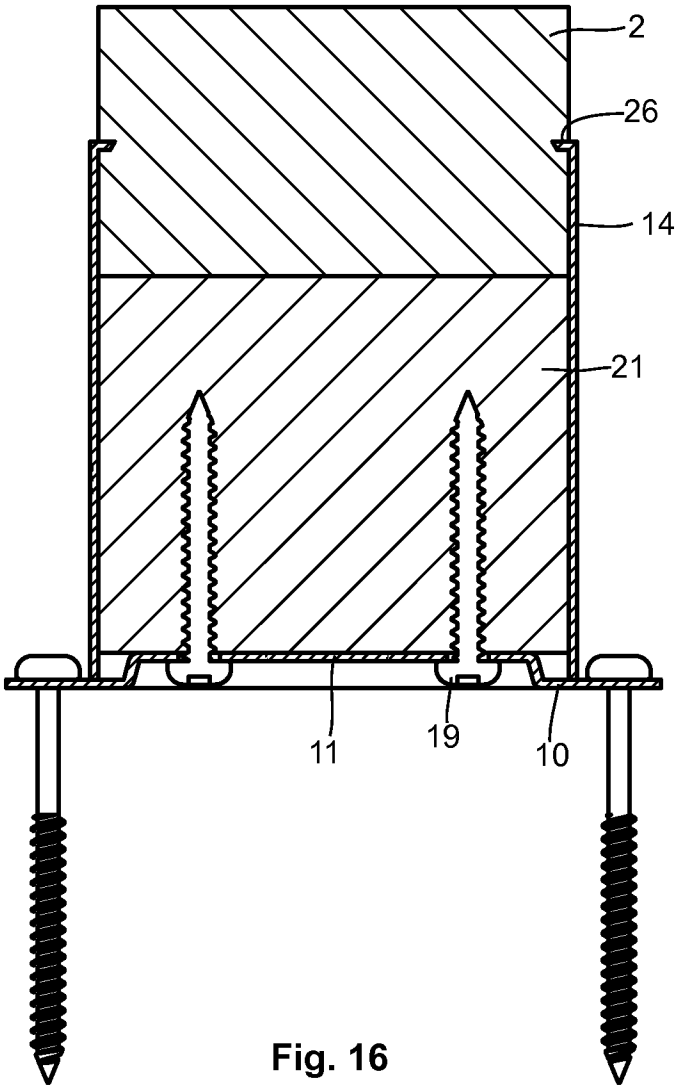
FIG. 16 is a cross section showing an embodiment of the device with an embossed elevated base as used in with a continuous post.

Referring to FIGS. 16 and 17, there is depicted cross sectional views showing how the apparatus is used in post repair applications when an embossed 11 elevated base 10 is employed. The cutting blades 26 are fully embedded into the side wall of the post. The heads of the larger screws 19 are shown fitting inside the cavity under the elevated base. FIG. 17 is another cross sectional view of a the same apparatus but rotated 90 degrees to show the details of the screws 8 that secure the cover panels 14 together, the mid span screws 23 that pull the blades 26 in tighter against the post walls and the optional screw 4 in the middle of the cover panel. The cross sectional view of the left side of the apparatus also begins between the V cut at the corner, thus omitting the view of the blade 26 on this view.

The following describes both the characteristics of the device and the method of employing it.

The first step of using an embodiment of the present invention is to locate a support post with a rotted bottom portion. The extent of the rot must be determined and one should allow a zone of safety of at least 1 inch above the rotted area. A horizontal line is circumscribed around the post. The structure above the post should be temporarily supported by another post while the rotted portion is cut off, preferably with a reciprocating or circular saw. The void between the post end and the surface of the grade or concrete is accurately measured. With the elevation of the base of the device in mind, either with an embossed surface or a "stand off" component, the height of the filler block must be accurately measured so that the combined heights of base of the device and filler block exactly match that of the void. Depending on the embodiment of the device, the filler block is either a) secured to the embossed base of the device by standard fasteners that screw up through the support base of the device from underneath its bottom surface; or b) secured to the "stand off" component which is welded to the base plate to create a minimum one inch elevation above the concrete grade. The filler block would usually be identical nominally sized lumber as that of the post but could be any high density synthetic material.

It is the cover panels in conjunction with the post base device and filler block that provide the heretofore unaddressed benefits of improved lateral and torsion strength, a near perfect mechanical seal (except for the small exposed corner portion which is covered by a dab of caulking) and the freedom to variably select where to cut the old post within the range of the height of the panels while removing the rotted portion.

It should be noted that a variety of flat planer bases that elevate the end of the filler block above the surface could potentially be used with the post cover panels and achieve the effect of maintaining a firmly connected base to surface grade connection. But it is the design of the base of this device in concert with the cover panels which provide additional protection against any water or moisture that may accumulate on the surface of the base proximate to the end of the post or filler block.

An embossed elevated base would provide a minimum level of protection from surface moisture. A "stand off" component would provide a greater level of protection with building code standards in mind. A "stand off" component with a filler block would provide even greater protection to a repaired post. In any of these three scenarios, the post cover panels provide protection from water and insects and provide excellent torsion and lateral strength.

Construction adhesive is applied to the top surface of the filler block. The support base with attached filler block is then fitted into the void. Any excess adhesive that is squeezed out can be wiped off for a clean installation. The support base itself has either an embossed elevated center portion or taller "stand off" component, the perimeter lines of which lie within the periphery of the bottom of the filler block to encourage water and moisture to drain freely and cleanly away from the its bottom if moisture or water ever gained access to this area. This also ensures that if water accumulates on the base of the device that the end of the post or filler block would still remain elevated and dry. It also ensures that if any moisture or condensation ever found its way into the concealed area it would drip cleanly from the edge of the block to the base below.

In addition, vertical tabs creating a surface area formed into the base proximate to the periphery of the elevated portion. This surface aligns within the periphery of the filler block walls so that the inside face of the post cover panels in turn make full contact with the surface of the tabs. Optional screws can be driven through the bottom edge of the cover panels into the vertical tabs. This option may provide further strength to the entire assembly but may be unnecessary.

Once the base and filler block are situated directly under the post to be repaired, the first section of the post cover panel which resembles a corner section is placed roughly in position at one of the corners of the block and post. The panel is moved closer into the corner of the post until the sharp edges of top horizontal flanges or blades make contact with the post walls above the joint connection. The shapes of the cutting edges of the blades are designed to cut into the side wall of the post from an initial impact of force directed at the corner bend. The force sets the corner of the panel tight against the post where there is no blade. The blade corners are angled (not perpendicular) to the cutting edge of the blade—i.e. the edge of each corner has is at an angle 41 greater than 90 degrees to the cutting edge of the blade flange, preferably greater than 110 degrees, or about 135 degrees. The angled corner edges facilitate the blade to both cut into the post and move tangentially along the side of the post. Once the corner and first part of the blade are set, a direct impact against the post sets the rest of the blade. This does not require excessive force as it only needs to cut about ⅛" or less into the post to create a mechanical seal. This method is important so as to set the corner of the panel and the blades tightly against the corner of the post before setting the rest of the edges of the blade into the post. The small gap or break in the seal at the "V" cut in the corner of the panel where the flanges do not extend to is later sealed with a small dab of exterior caulking. A reliable long term mechanical seal is thereby been completed. Caulking is used only as it is intended to be used—in small discrete areas rather than as the singular critical element of any exterior sealing system.

The second cover panel is placed around the opposing corner of the post and care is taken to ensure that one of the vertical edges of the panel is aligned so that as it is driven into final position it slides underneath the overlapping portion of the other cover panel. Sideways force is again applied along the sharp flange ensuring a complete mechanical seal around the post walls and another small dab of caulking is place at the corner gap. The "V" cuts in the top corners of the panels allow the top portion of each side of the cover panel to move freely of one another towards the post wall as they are struck by a hammer. Usually a hammer strike is sufficient to set the blade completely into the post wall. If desired a single screw could also be driven through at mid span of the top edge of the panel.

Two self drilling screws are driven through the overlapping vertical flanges of the two corner panel members making the entire panel structure a single unitary entity. This itself provides a high degree of lateral impact and torsion strength to the joint between the old post and filler block. In installations where a filler block is employed, two fasteners are screwed through the panels into opposite walls of the upper original post to further secure the panel and post. This ensures that the panels are mechanically connected to both the old post and the filler block so that the glued joint is not the only means of connection.

Two other fasteners may be screwed through the lower portion of the panels into opposite walls of the filler block (but adjacent to the previous screws) which is in turn connected directly to the support base by fasteners or with an intermediary spacer of metal or high density synthetic material. Incidentally the lateral screws also comply with a requirement under the building code for support posts if they are to meet uplift standards such as for hurricanes.

The repaired post has both the compression and lateral torsion strength of a new post because of the filler block and the wrapping panel covers. It also has a mechanically sealed joint that will remain dry. The only maintenance required is to inspect the corner dabs of caulking on an annual or bi-annual basis and repair as needed. The post to base to surface connection keeps the post end covered from direct exposure to the elements and pests, such as termites, yet it allows air flow underneath the post bottom to ensure it can dry out easily should water fins its way in. As well, the slim profile of the cover panels closely follows the vertical profile of the original post walls for an improved aesthetic appearance.

While the illustrated embodiments are adapted to square or rectangular support posts, alternative embodiments of the present invention are adapted to round posts, in which case the cover panels would be semi-cylindrical in overall shape to conform to the external dimensions of a round post.

Other aspects and features of the present invention will become apparent to those of ordinary skill in the art upon review of the following description of specific embodiments of the invention in conjunction with the accompanying figures.

While the above description and illustrations constitute preferred or alternate embodiments of the present invention, it will be appreciated that numerous variations may be made without departing from the scope of the invention. It is intended that the invention be construed as including all such modifications and alterations.

What is claimed is:

1. A post support device for securing the bottom of a wooden support post to a surface, the device comprising:

a base adapted to being attached to the surface;

elevation support means in cooperation with the base for supporting the post or a filler block if one is used in a position above the base;

at least two cover plates, each cover plate being adapted to covering a portion of the exterior of the post, each cover plate further including an elongate flange portion facing inward towards the post and being positioned generally transverse to the longitudinal axis of the post, said flange portion including a leading cutting edge to enable the flange portion to pierce into the post upon an application of force to the flange portion to provide a mechanical seal between the flange portion and the post;

first fastening means for securing each cover plate to the post; and second fastening means for securing the base and the elevation support means to the post or the filler block if one is used.

2. The device as claimed in claim 1, wherein the cover plate defines a top edge and the flange portion is adjacent the top edge, the top edge further includes at least one V-shaped cutout to enable the flange portions on either side of the cutout a limited range of movement relative to each other.

3. The device as claimed in claim 1, wherein the elevation support means comprises a raised area embossed into the base.

4. The device as claimed in claim 1, wherein the elevation support means comprises a formed member being connectable to the base and having an elevational thickness that supports the post or the filler block if one is used in a position at that distance above the base.

5. The device as claimed in claim 4, wherein the elevational thickness is at least one inch.

6. The device as claimed in claim 1, further including upwardly extending tabs on an upper surface of the base wherein the tabs are located on the inside and are aligned with the cover plate when the device is assembled, and third fastening means for securing each cover plate to at least one of said tabs.

7. The device as claimed in claim 1, wherein the elevation support means defines a periphery that is smaller than the periphery of the post or the filler block if one is used.

8. The device as claimed in claim 1, wherein the cover plates together in the assembled device completely envelope the periphery of the post.

9. The device as claimed in claim 8, wherein each cover plate includes complementary overlapping side edges at each end, one being an underlying edge and the other being an overlying edge, wherein the overlying edge of one cover plate overlaps with the underlying edge of the adjacent cover plate.

10. The device as claimed in claim 9, further including fourth fastening means for interconnecting the overlapping side edges on adjacent cover plates and simultaneously securing them to the post.

* * * * *